US005135164A

United States Patent [19]

Auer et al.

[11] Patent Number: 5,135,164

[45] Date of Patent: Aug. 4, 1992

[54] PRESTRESSED CONCRETE RAILROAD TIE

[75] Inventors: Peter Auer, Ottobrunn; Josef Eisermann, Munich; Helmut Lieske, Munich; Günther Leykauf, Munich; Peter Plica, Munich, all of Fed. Rep. of Germany

[73] Assignee: Dyckerhoff & Widmann Aktiengesellschaft, Munich, Fed. Rep. of Germany

[21] Appl. No.: 579,872

[22] Filed: Sep. 7, 1990

[51] Int. Cl.[5] ..... E01B 3/34

[52] U.S. Cl. ..... 238/91; 238/83

[58] Field of Search ..... 238/91, 92, 85, 84

[56] References Cited

U.S. PATENT DOCUMENTS 4,150,790 4/1979 Potter ..... 238/91 X

FOREIGN PATENT DOCUMENTS 0361227 4/1990 European Pat. Off. ..... 238/91
941980 7/1949 Fed. Rep. of Germany ..... 238/91
960117 4/1950 France ..... 238/91

*Primary Examiner*—Robert J. Spar
*Assistant Examiner*—James Eller
*Attorney, Agent, or Firm*—Akoo-Toren

[57] ABSTRACT

A prestressed concrete railroad tie having a tie body made up of two end members for supporting rail attachment parts and a central section extending between and interconnecting the end members and having a transverse cross-section smaller than the transverse section of the end members. Tendons are located in the tie body and extend in opposite directions from a common vertical or horizontal plane in the central section into the end members. At tie ends of the end members the tendons are anchored and are uniformly distributed across the transverse cross-section of the end members. With the tendons centered in the central member, a narrow central member is afforded. The tendons fan outwardly from the common plane in the central section into the end members providing wider or larger end members. This prestressed concrete tie arrangement affords only low changing bending moments in the central section or a positive course of bending moments across the length of the tie.

3 Claims, 3 Drawing Sheets

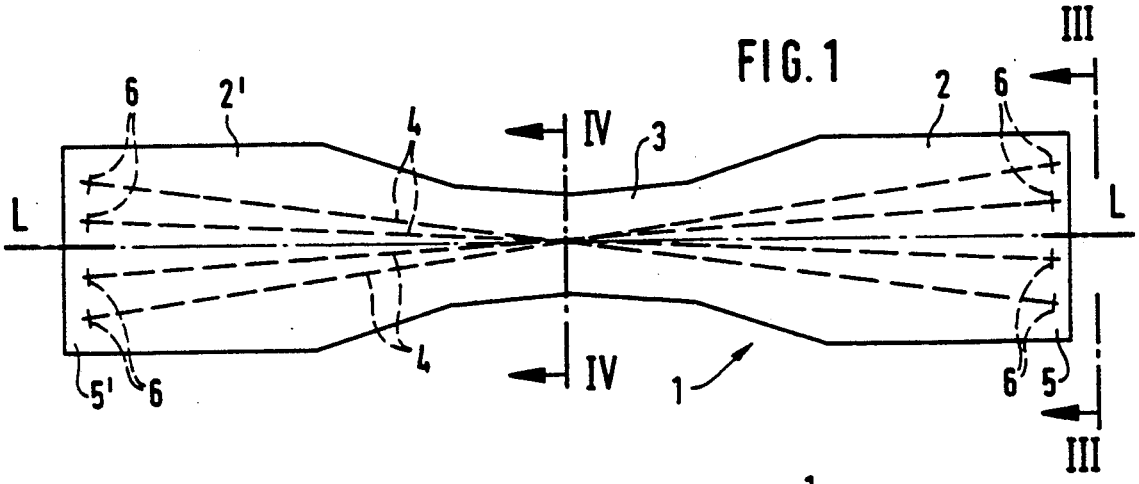
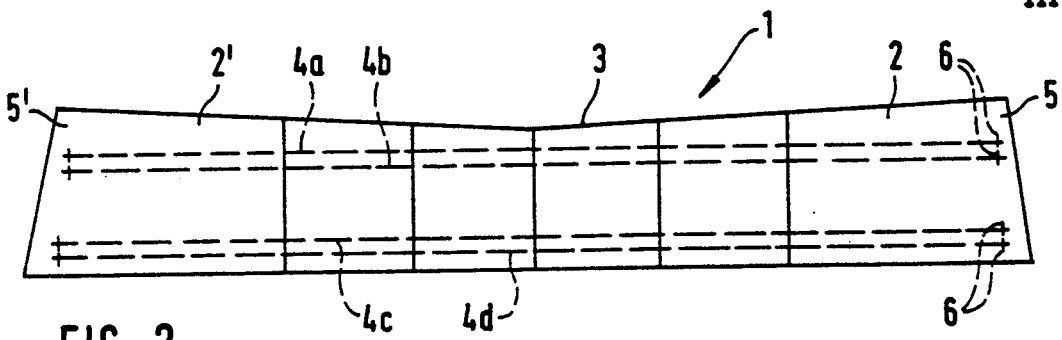
FIG. 2
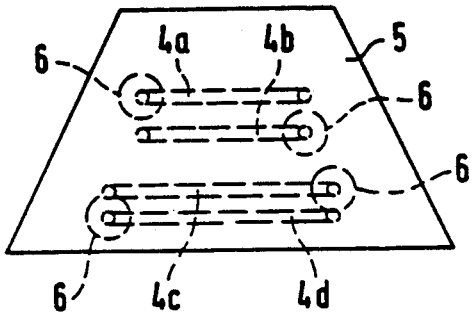
FIG. 3
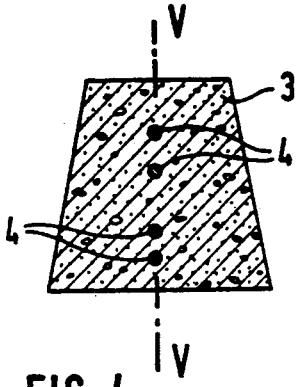
FIG. 4
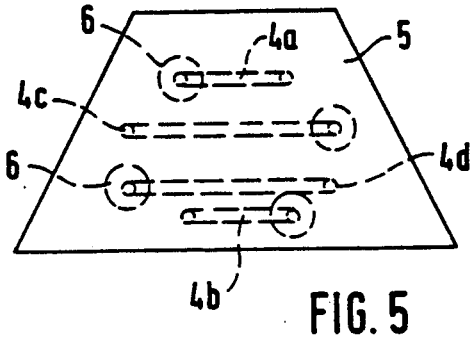
FIG. 5

PRESTRESSED CONCRETE RAILROAD TIE

BACKGROUND OF THE INVENTION

The present invention is directed to a prestressed concrete railroad tie having a monolithic tie body and to a method of fabricating the tie.

Railroad ties constructed as a monolithic tie body including two end members carrying the attachment parts for the rails and a central member interconnecting the end members are made of reinforced concrete. The advantage of such tie members is that the abutting support forces of the ballast beds are concentrated in the region about the axes of the rails. As a result, there is a reduction in the bending moments, particularly in the slender central member of the tie affording a lower reinforcing steel requirement with a corresponding reduction in costs. The more costly fabrication of the concrete reinforcement and the danger or crack formations in the tie member when subjected to oscillating loads are disadvantages of this type of tie and has greatly reduced the practical significance of such ties.

In prestressed concrete ties, the tie body has, for the most part, a prismatic shape. As a result, such ties experience higher bending moments as compared to a tie member with a central slender member or part. Such ties have been accepted because of the simple straight line course of the prestressing elements or tendons. A marked transverse crosssectional reduction in the central part of the tie body has not been possible with prestressed concrete ties, since the position of the individual tendons is fixed initially by the required uniform distribution of the end anchors across the transverse cross-sectional of the tie ends

SUMMARY OF THE INVENTION

Therefore, it is a primary object of the present invention to provide a prestressed concrete railroad tie where the transverse cross-section of the central region of the tie body extending between the end members is reduced, while maintaining the uniform distribution of the end anchors for the tendons at the tie ends. With such an arrangement a more favorable distribution of the bending moments is attained and with it a saving in the amount of prestressing steel.

In accordance with the present invention a prestressed concrete railroad tie is provided with a central section having a smaller transverse cross-section than the end members with the reinforcing used as the prestressing tensioning elements or tendons being steel rod, wires or strands, which are located in a common vertical and/or horizontal plane in the central section of the tie and extend in a radiating or fan-like manner essentially in a straight line to the tie ends where they are anchored in a uniformly distributed manner across the transverse cross-section of the tie end.

Preferably, the prestressing members or tendons extend rectilinearly between the end members or parts of the tie and cross in the center of the tie.

Accordingly, two prestressing members extending at the same angle are inclined oppositely with respect to the long axis of the tie and are located in planes parallel to one another forming a pair of prestressing members. At least two prestressing member pairs can be arranged next to one another or one above the other or one pair can be arranged between the prestressing members forming the other pair. The end anchor of two prestressing members can be formed by a curved or bight section interconnecting the adjoining ends of such members.

In the fabrication of ties on a long casting bed a particular embodiment is desirable where two prestressing members or tendons are located at the tie ends equally spaced from a long axis of the tie and are joined together in the center of the tie between the ends and are retained by a connecting part.

By interconnecting the prestressing members in the center of the tie body in a crossing arrangement of parallel runs of the prestressing members, it is possible to construct a tie body with a narrow central web connecting wide tie ends using such prestressing members whereby only low changing bending moments are developed in the central part or where a single sense positive course of the bending moments along the entire tie length can be made possible. As a result, a uniform distribution of the end anchors across the transverse cross-section of the tie end can be achieved with comparatively wide tie ends, because of the manner in which the prestressing members fan out from the center of the tie to the ends. Further, the arrangement of the end anchors offset with respect to one another, permits a pronounced eccentric position of the tendons in the tie cross-section.

Another feature of the invention is that the tie body can be arranged when the prestressing members are joined in a horizontal plane with the central section having a reduced height rectangular transverse cross-section, so that the tie is elastic or resilient.

By employing the present invention there is a considerable reduction in the quantity of prestressing steel required for a prestressed concrete tie. While in previously known ties the quantity of prestressing steel has been about 5 kg for each tie, by using the present invention there is a reduction of approximately 40% so that the prestressing steel for each tie is about 3 kg.

The present invention also provides a method of fabricating prestressed concrete ties on a long casting bed with the prestressing members or tendons being stressed between fixed abutments extending in several rows, and with the ties being formed at separate stations along the casting bed length one following the other. Initially, the prestressing members are placed in parallel and are tensioned, and subsequently a pair of the prestressing members are connected at each fabrication station in a corresponding form work mold at the center of the tie along their length, so that they are held together by the connecting parts.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DESCRIPTION OF THE DRAWINGS

In the drawings:

FIG. 1 is a schematic plane view of a prestressed concrete tie embodying the present invention with straight tendons crossing one another;

FIG. 2 is a schematic elevational view of the prestressed concrete tie in FIG. 1;

FIG. 3 is an end view of the tie taken along the line III—III in FIG. 1;

FIG. 4 is a transverse cross-section through the center of the tie taken along the line IV—IV in FIG. 1;

FIG. 5 is an end view of a tie, similar to FIG. 3, with another arrangement of the tendons;

DETAILED DESCRIPTION OF THE INVENTION

Figure 6:
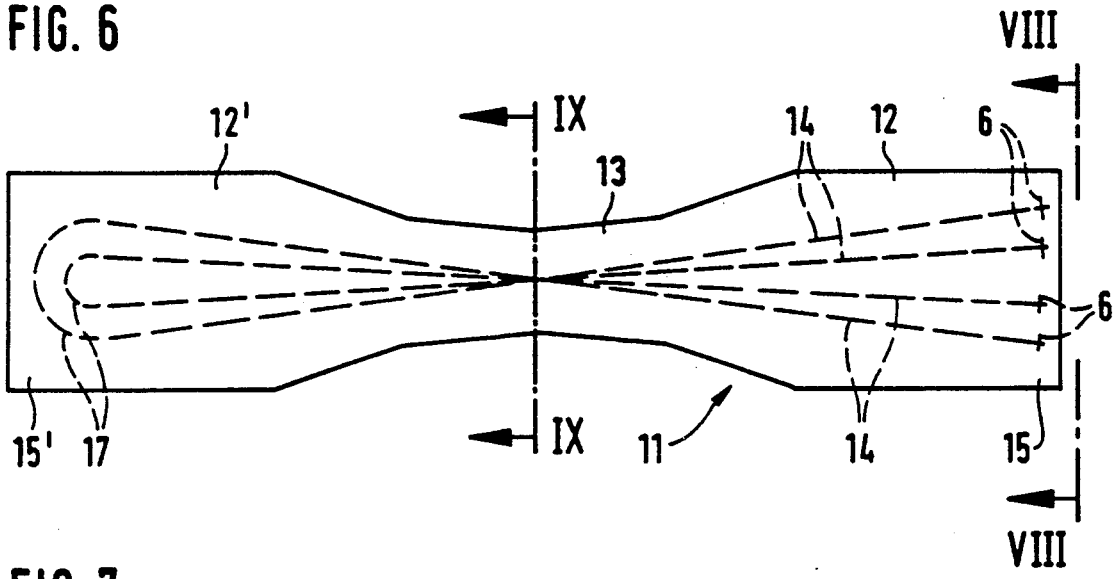
FIG. 6 is a schematic plan view of a prestressed concrete tie with loop-like tendons disposed in a crossing arrangement.

A first embodiment of a tie body 1 and the arrangement of its prestressing members or tendons 4 is shown schematically in FIGS. 1–4. Tie body 1 comprises two relatively wide end support members 2, 2' at the opposite ends of the tie elongated in the direction between the end support members. End support members 2, 2' carry rail attachment means not illustrated in the drawing for sake of clarity. A central section 3 extends between and interconnects the end support members 2, 2'. Central section 3 is stepped inwardly from the side surfaces of the end support members having a necked down appearance. As can be seen in FIG. 4 the transverse cross-section of the central section 3 is considerably smaller than the transverse shape of the end support members as shown in FIG. 3. Tie body 1 is reinforced by four straight tendons 4 anchored at tie ends 5, 5' of the end support members by end anchors 6.

Tendons 4 consists of steel rods, wires or strands and are located one above the other in a vertical plane V—V in the center of the tie, note FIG. 4 and fan out from the vertical plane toward the tie ends 5, 5'. The tie body 1 has a central axis L—L extending in the long direction between the tie ends 5, 5'. At the vertical plane V—V in the center of the tie the tendons are located on the axis L—L. As the tendons extend from the vertical plane they fan out away from the central axis L—L, as can be seen in FIG. 1, forming an angle with the axis. The tendons are secured at the opposite ends adjacent to the tie ends 5, 5' by anchors 6, shown only schematically, and as is known, may be formed by anchor nuts, wedges or the like. The anchors 6 are uniformly distributed across the surface of the preferably trapezoidal cross section at the tie ends 5, 5', note FIG. 3. This embodiment permits the construction of a very slender central section while maintaining an adequate concrete covering about the tendons.

The geometry of the tendons 4 fanning out from the long axis L—L does not permit an arrangement symmetrical about the vertical center line V—V of the transverse cross-section in FIG. 4. If the usual conditions for prestressed concrete ties are observed, that is, that no horizontally acting bending moments and no torsional moments can be generated by the prestressing action, since such moments would result in undesirable deformations and twisting of the tie, then only a few possibilities remain for the distribution of the end anchors 6 at the tie ends 5, 5' as shown in FIGS. 3 and 5. In FIGS. 2 and 3 the combination of two tendons 4*a*, 4*b* and 4*c*, 4*d* into a pair of tendons is displayed. The tendons 4*a*, 4*b* or 4*c*, 4*d* of each pair have an equally large but oppositely arranged inclination to the long axis L—L of the tie, note FIG. 1 and they extend in horizontal planes parallel to one another, note FIGS. 2 and 3. The inclined or fanned out arrangement with respect to one another and the spacing of the tendons 4*a*, 4*b* or 4*c*, 4*d* forming the pairs are selected so that no torsional moments arise. The anchors 6 are arranged in an identical manner at each of the tie ends 5, 5'.

Another arrangement of the tendons is displaced in FIG. 5 where the shape of the tie end 5 is similar to that in FIG. 3, however, one pair of tendons 4*c*, 4*d* is placed between the tendons 4*a*, 4*b* of the other pair, to prevent a possible generation of torsional moments.

In view of these two basic arrangement with four individual rectilinear tendons 4, there are other possibilities for the distribution of the end anchors 6, depending on the requirements and the load by multiplying the tendons. The insertion of individual tendons located in the vertical plane V—V and extending parallel to the long axis L—L of the tie is also possible.

Figure 7:
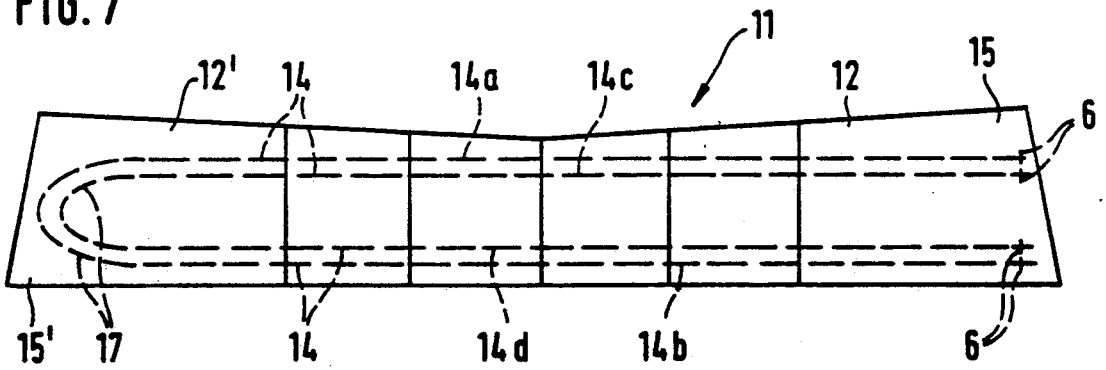
FIG. 7 is a schematic elevational view of the prestressed concrete tie shown in FIG. 6.
Figure 8:
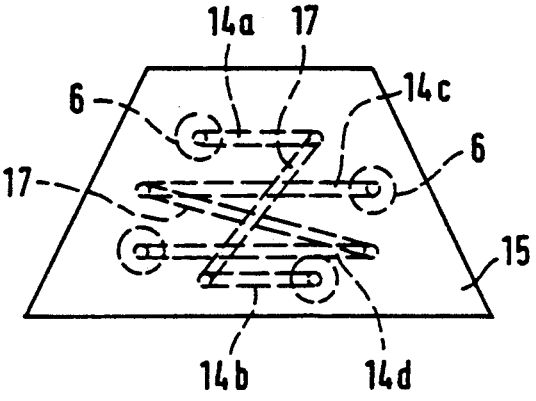
FIG. 8 is an end view of the tie taken along the line VIII—VIII in FIG. 6.
Figure 9:
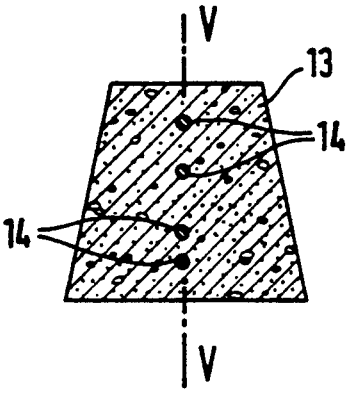
FIG. 9 is a transverse cross-section through the center of the tie taken along the line IX—IX in FIG. 6.

To reduce the number of end anchors it is known in prestressed concrete ties to use hairpin-like reinforcing elements made up of two rectilinear tendons interconnected at one end by a curved part of bight 17 so that a single tendon unit is formed. In FIGS. 6–9, a prestressed concrete tie is shown with a tie body 11 made up of two wide end support members 12, 12' interconnected by a reduced width central section 13 with the tie body reinforced by tendons 14 of a hairpin-like shape. As in FIG. 5, two tendons 14*a*, 14*b* or 14*c*, 14*d* constitute a pair with the tendons of each pair connected by a loop-like bight part 17. The anchoring loops or bight parts 17 should extend at right angles to one another to the extent possible, to diminish tensile fissure forces generated by the reversal of forced lines, note FIG. 8. The position of the bight parts 17 at the tie end 15' is shown in FIGS. 6 and 7. FIGS. 7 and 8 illustrate the course of the tendons 14*a*, 14*b* and bight part 17 and 14*c*, 14*d* and bight 17 in the tie cross section over the length of the tie with anchors 6 provided at the tie end 15. The anchors at the opposite tie 15' are formed by the bight part 17.

Figure 10:
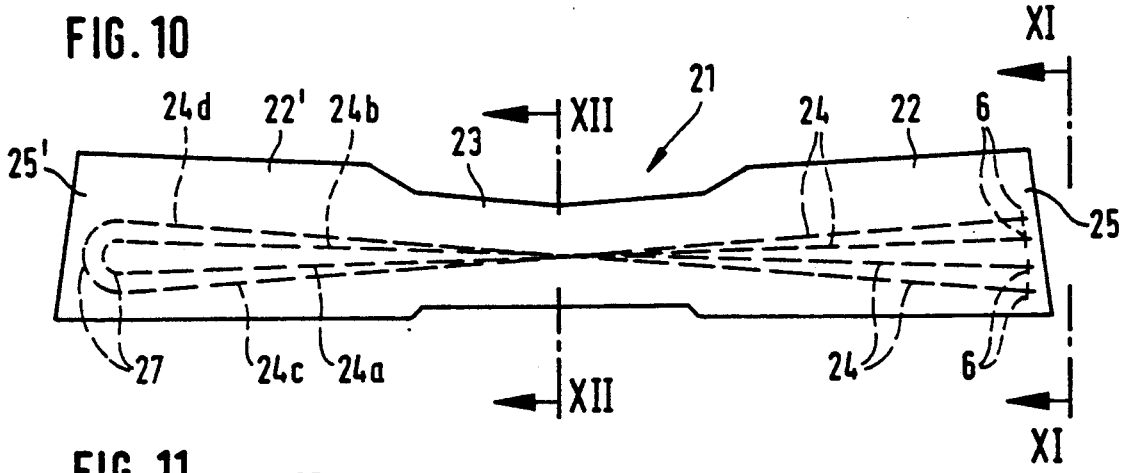
FIG. 10 is a schematic elevational view of a prestressed concrete tie with a reduced transverse cross-section in the center and with loop-shaped tendons.
Figure 11:
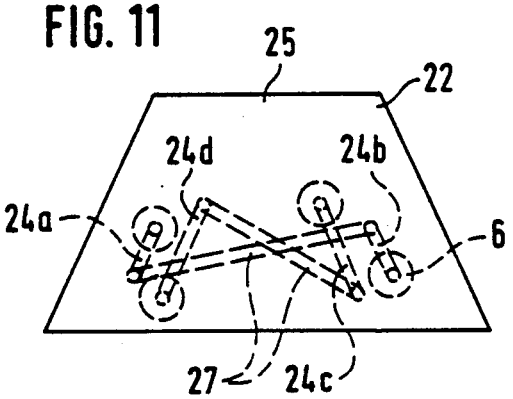
FIG. 11 is an end view of the tie in FIG. 10 taken along the line XI—XI in FIG. 10.
Figure 12:
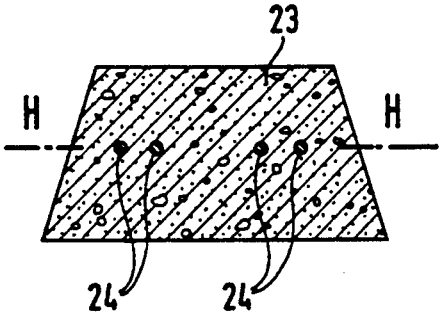
FIG. 12 is a transverse cross-section through the center of the tie in FIG. 10 taken along the line XII—XII.

Another arrangement of a prestressed concrete tie is set forth in FIGS. 10 to 12 where the tie body 21 has a reduced height central section 23 centered between the end support members 22, 22', and such ties are known as ties with a "resilient central section". As can be seen from the drawing, the path or direction of the tendons 24 is achieved by turning the arrangement shown in FIGS. 6 to 9 through 90° around the long axis of the tie. FIG. 10 displays in the long axis direction the position of two pairs of tendons 24*a*, 24*b* or 24*c*, 24*d* which in both directions from the center of the tie, section XII—XII, fan out in the upward and downward directions. As shown best in FIG. 12, at the center section all of the tendons 24 are located in a single horizontal plane H—H at the center of the tie.

With regard to the arrangement of the tendons, FIG. 11 provides an end view of tie end 25. The basic arrangement of the tendon pairs 24*a*, 24*b* or 24*c*, 24*d* correspond to FIG. 8 after being turned through 90° around the long axis of the tie. In this arrangement tendons 24*c*, 24*d* in one pair are located between and inwardly of the tendons 24*a*, 24*b* of the other pair. It should be evident that the use of individual rectilinear tendons 24 with end anchors 6 at both ends is also possible in this embodiment, although the tendons 24 are shown with bight parts 27.

Figure 14:
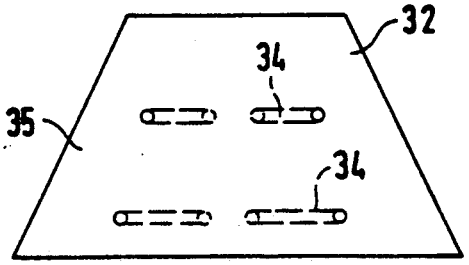
FIG. 14 is an end view of the tie in FIG. 13 taken along the line XIV—XIV.
Figure 15:
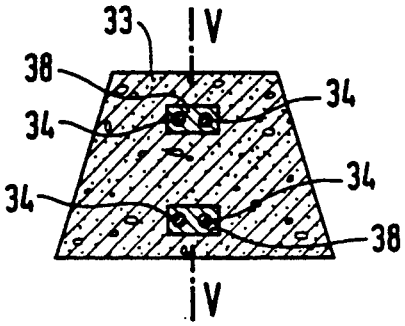
FIG. 15 is a transverse cross-section through the center of the tie in FIG. 13 taken along the line XV—XV.

Connecting a pair of tendons into a tight parallel course in the center of the tie also possible instead of a crossed arrangement of the tendons at the center as has been described. Such an embodiment, especially suitable for the fabrication of prestressed concrete ties on a long casting bed with an immediate bond, is shown in FIGS. 13 to 15.

Figure 13:
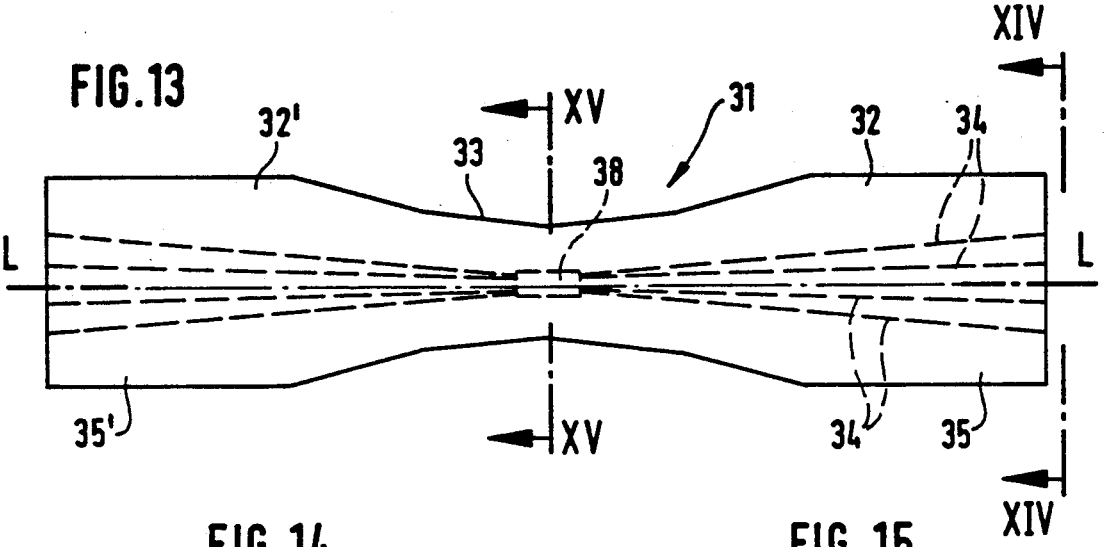
FIG. 13 is a schematic plan view of a prestressed concrete tie with the prestressing members or tendons joined together in the center of the tie.

In FIG. 13 a schematic plan view of a tie body 31 is set forth with wide end support members 32, 32' and a necked down or narrower central section 33 with rectilinear tendons 34 extending between the end support members and joined together in the center of the tie, section XV—XV, in pairs on the long axis L—L and each pair secured together by a connecting member 38. In FIG. 15 illustrating section XV—XV, connecting part 38, designed as a clamp, is required for the center section of the tendons 34. The design of the connecting part 38 as a clamp has the advantage that it can be placed from the side of the tendon along its path, that is, the tendon does not have to be threaded through a ring. A arrangement of the end anchors symmetrical with respect to the long axis is provided at the tie ends 35, 35', note FIG. 14, since in the fabrication of a prestressed concrete tie on a long casting bed anchoring can be effected without special anchors by a gripping or adhesive bond, the end anchors shown in FIG. 14 are to be viewed only as wire ends.

When fabricating prestressed concrete ties on a long casting bed, usually first the tendons are laid out parallel to one another continuously along the tensioning path and are stretched between fixed abutments. The tendons 34 are guided in a known manner, such as in slot-like recesses in the ends of formwork molds at the tie ends 35, 35'.

In a second step, starting at the fixed abutment of the prestressing path, the tendons are joined in the first formwork mold at the center in the long direction into pairs by suitable devices and are held together by connecting part 38 formed of metal or plastics. The tension force developed by the connection of the tendon can be reduced automatically by a regulator to the predetermined desired value at the stretching press of a mobile prestressing abutment.

Subsequently, connecting parts 38 are attached in an appropriate manner at the following formwork molds, and again the increased tensioning force is reduced. This process is repeated until the last formwork mold at the mobile prestressing path abutment is reached. The other steps of the formation of the prestressed concrete ties then follows in the usual manner.

While specific embodiments of the invention have been shown and described in detail to illustrate the application of the inventive principles, it will be understood that the invention may be embodied otherwise without departing from such principles.

We claim

1. A prestressed concrete railroad tie comprising:

a monolithic tie body having a longitudinally extending axis extending in a long direction of said tie body, said tie body including two end members spaced apart in the long direction and each forming a tie end arranged to support rail attachment parts, and a central section extending between and interconnecting said end members, said central section having a smaller cross-sectional area transverse to the long direction than a cross-sectional area of said end members;

a plurality of separate steel tendons in the form of one of rods, wires and strands, said tendons having first and second ends, said tendons extending through said tie in the long direction thereof, said tendons extending rectilinearly between said tie ends and crossing in the longitudinal center of said central section on said tie, said tendons being located in a common vertical line of a vertical plane extending through said longitudinal center of said central section, said tendons fanning laterally outward from the longitudinally extending axis in a direction from said longitudinal center toward said tie ends; and a plurality of anchor means fixed to said ends of said steel tendons and located at the tie ends, said anchor means being distributed across a transverse cross-section at said tie ends.

2. Prestressed concrete railroad tie, as set forth in claim 1, wherein said tendons are arranged in pairs (4*a*, 4*b*, and 4*c*, 4*d*) fanning laterally at the same angle from said longitudinally extending axis but extending on opposite sides of said axis and arranged in parallel horizontal planes.

3. Prestressed concrete railroad tie, as set forth in claim 2, wherein at least two pairs of said tendons (4*a* and 4*b*, and 4*c* and 4*d*) are arranged within said tie body with one said pair located above the other said pair.

* * * * *

UNITED STATES PATENT AND TRADEMARK OFFICE

CERTIFICATE OF CORRECTION

PATENT NO. : 5,135,164

DATED : August 4, 1992

INVENTOR(S) : Peter Auer, et al

It is certified that error appears in the above-indentified patent and that said Letters Patent is hereby corrected as shown below:

On title page, item [75] Inventors: should read as follows;

--Peter Auer, Ottobrunn; Josef Eisenmann, Munich--

Signed and Sealed this

Twenty-fourth Day of August, 1993

Bruce Lehman

*Attest:*

BRUCE LEHMAN

*Attesting Officer*

*Commissioner of Patents and Trademarks*